United States Patent [19]

Bellagamba

[11] Patent Number: 5,069,456

[45] Date of Patent: Dec. 3, 1991

[54] GOLF TRAINING APPARATUS

[75] Inventor: Miro D. Bellagamba, Orlando, Fla.

[73] Assignee: International Sports Technology, Inc., Orlando, Fla.

[21] Appl. No.: 677,145

[22] Filed: Mar. 29, 1991

[51] Int. Cl.[5] ..... A63B 69/36

[52] U.S. Cl. ..... 273/183 E; 273/191 A; 273/187 R

[58] Field of Search ..... 273/191 R, 191 A, 191 B, 273/192, 183 R, 183 E, 183 B, 187 R, 186 R, 186 C

[56] References Cited

U.S. PATENT DOCUMENTS

| | | | |
|---|---|---|---|
| 1,399,761 | 12/1921 | Garland | 273/191 A X |
| 1,960,787 | 5/1934 | MacStorker | 273/191 A |
| 4,071,251 | 1/1978 | Beckish | 273/191 A X |
| 4,852,881 | 8/1989 | Bellagamba et al. | 273/191 A X |

*Primary Examiner*—George J. Marlo
*Attorney, Agent, or Firm*—William M. Hobby, III

[57] ABSTRACT

A golf training apparatus has a frame and a golf club swing guide is formed as a partial circle of high density polyethylene pipe and is attached to the frame for guiding a person's backswing of a golf club. The golf swing training apparatus guides only the golfers backswing but forces the forward swing of the golfer to hit the ball under the guide member. The golf club swing guide is adjusted by sliding as center swing guide support member relative to a pair of side swing guide support members. The golf club swing guide is attached to frame and guides a person's backswing, along a partial circular pipe member having two ends and having a flexible support member connected between the end portions which support member is positioned to align a golfer's shoulders with a target. A second center swing guide support is provided to support an attachment which forms the upper half of a full circle guide when attached to the partial circle guide. The opposite ends of the partial circle guide are connected by a flexible elastic cord which is used to align a golfer's shoulders with a target.

12 Claims, 2 Drawing Sheets

GOLF TRAINING APPARATUS

BACKGROUND OF THE INVENTION

The present invention relates to a golf training apparatus and especially to a golf training apparatus for guiding the swing of a golf club.

Proper striking of a golf ball requires more than a simple swinging motion of the golf club. Numerous factors come into play, any one of which, if improperly executed can cause a poor golf shot. A proper address of the ball by the player, proper grip of the club, proper body position and proper swing of the golf club are four of the key variables that must be correctly executed to achieve a good shot. If, however, the player properly addresses the ball, properly grips the club and assumes the correct body position, an erroneous shot can still result due to improper swing of the golf club. Further in this regard, if one does not swing the golf club properly, the golfer's head can be forced into movement, the club head can be pulled out of proper alignment with the golf ball, the body can be forced into an incorrect position, and the like. Any one of these errors could spell disaster to the shot. It is therefore, quite essential that the player properly swing the golf club. In fact, a properly swung club can force one to meet other criteria that are necessary for the successful golf shot. The correct swing of the golf club is therefore very important to a successful execution of the golf shot whether off the tee, on the fairway, out of a sand trap, or the like.

The ranks of golf professionals, and low handicap amateurs are said to have "grooved" their swings. This statement refers to the fact that these individuals have mastered a correct swing of the golf club according to their individual physical makeup, so that swinging of the club in the proper manner is a natural reaction. Hence, the proper address is made, the club head is smoothly carried away from the ball in the proper arc, properly brought down into engagement with the ball and guided into a proper follow through after striking the ball. Each of these steps are accompanied by proper body action and reaction. In the "grooved" swing, one continually executes these functions as a natural event with a close degree of accuracy whereby a large majority of shots are consistent and predictable.

Throughout golf history, numerous items have been devised to facilitate education or instruction of a golfer in the art of stance, club grip, body movement, swing of the club and the like. In fact, numerous teaching aids have heretofore been devised for instructing one in the proper swing of a golf club. Such devices provide means to compel the individual to swing the club along a predetermined arc or plane. In general, these devices have utilized varying geometric swing paths for both back swing and follow through. A majority of these devices provide a slide or the like, secured to the apparatus and designed to receive a real or simulated club and follow the particular predetermined swing path. Numerous shaped swing paths have been shown in the prior art.

The present invention teaches a swing of a golf club utilizing a swing training system which can guide a swinging club on a back swing path while forcing the forward swing in a predetermined manner in order to hit the ball under the guide member of the swing training system.

Typical prior U.S. Patents which are pertinent to the present invention includes the Plunkett et al U.S. Pat. No. 2,520,287 which shows a golf club guiding device which captures a golf club and holds it in position for a spiral like swing. The Zega U.S. Pat. No. 2,653,025 is for a mechanical golf instruction aid which captures the golf club and holds it for a predetermined swing. The Plunkett et al U.S. Pat. No. 2,713,491 is a golf club guiding device for guiding the club in a predetermined manner. The MacStocker U.S. Pat. No. 1,960,787 is for a golf club guiding system directing the club around a predetermined swing. The Sciarrillo U.S. Pat. No. 4,040,633 is a golf swing training machine supported by a base sitting on an angled surface and guides the golf club on a spiraled pipe guide. The Wilson U.S. Pat. No. 3,794,329 is for a golf teaching apparatus in which the shaft of a golf club is attached to a sleeve which slides on a track to control the swing of a person practicing on the device. The Garland patent teaches an early mechanical golf teaching aid which also slides a shaft in a circular track. In the Hightower U.S. Pat. No. 3,744,799 a golf practice device has a guiding track for teaching the proper technique for swinging a golf club.

In my prior U.S. Pat. Nos. 4,852,881, dated Aug. 1, 1989, and U.S. Pat. No. 4,949,974, dated Aug. 21, 1990, both for GOLF TRAINING APPARATUS, a training apparatus was made mostly of PVC pipe and included a circular golf club guide with means for adjusting for different sized golfers.

SUMMARY OF THE INVENTION

The present invention relates to a golf training apparatus and especially to a golf club swing training apparatus having a frame and a golf club swing guide attached to the frame for guiding a person's swing of a golf club during a backswing and is either for left or right handed golfers.

A golf training apparatus has a frame and a golf club swing guide formed as a partial circle of high density polyethylene pipe attached to the frame for guiding a person's backswing of a golf club. The golf swing training apparatus guides only the golfers backswing but forces the forward swing of the golfer to hit the ball under and behind the guide member. The golf club swing guide is adjusted by sliding a center swing guide support member and a pair of side swing guide support members relative to each other. The golf club swing guide is attached to a frame and guides a person's backswing along a partial circular pipe member having two ends and having a flexible support member connected between the end portions. The frame includes a base formed of a plurality of pipe frame members and a pair of outrigger members and has a pair of side swing guide support members, and each swing guide support member is attached to the swing guide and each swing guide support member is slidably mounted in a supporting sleeve on a side upright frame member attached to the base. A center swing guide support member is attached to the swing guide and is supported in a supporting sleeve on a first center upright frame member attached to the base. A second center upright frame member is attached to the base and to the first center upright frame member. The simplified guide adjustment system allows for basic telescoping or sliding frame and guide support members as to both height and tilt of the guide and for locking them in place.

BRIEF DESCRIPTION OF THE DRAWING

Other objects, features and advantages of the present invention will be apparent from the written description and the drawings in which.

DESCRIPTION OF THE PREFERRED EMBODIMENT

Figure 1:
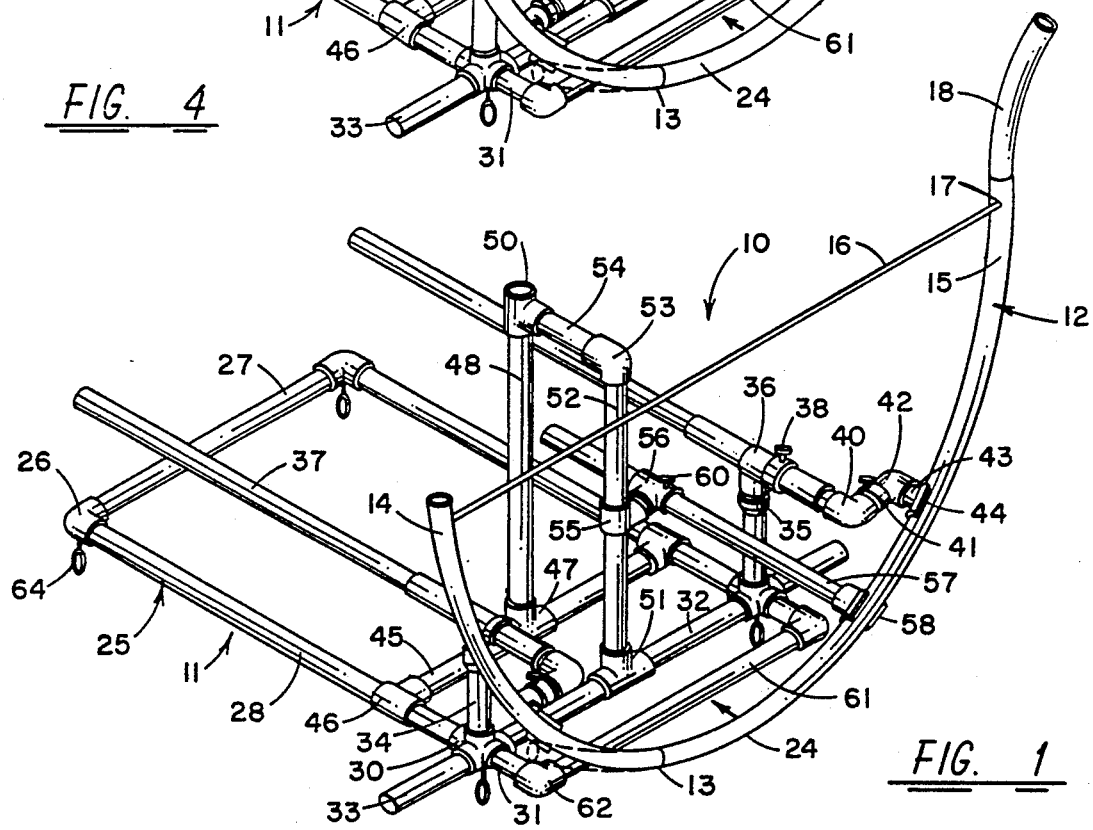
FIG. 1 is a perspective view of a golf training apparatus in accordance with the present invention.
Figure 2:
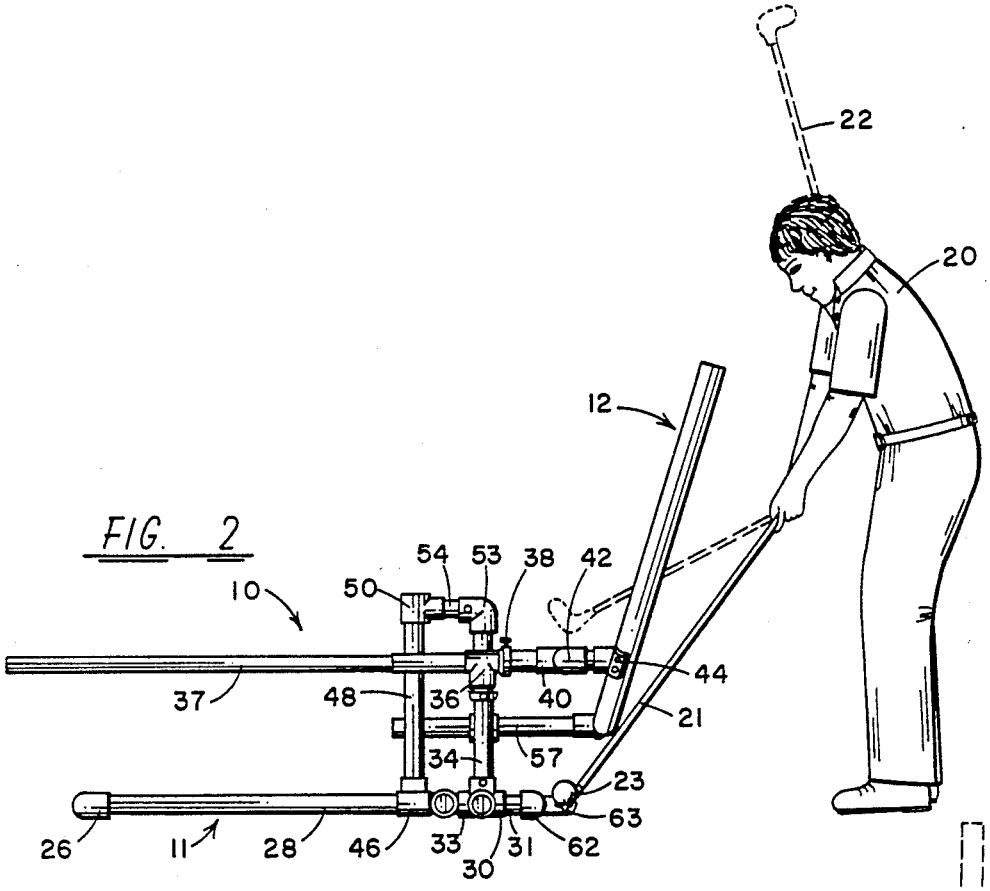
FIG. 2 is a side elevation of the golf training apparatus of FIG. 1 having a golfer positioned for a practice swing.
Figure 3:
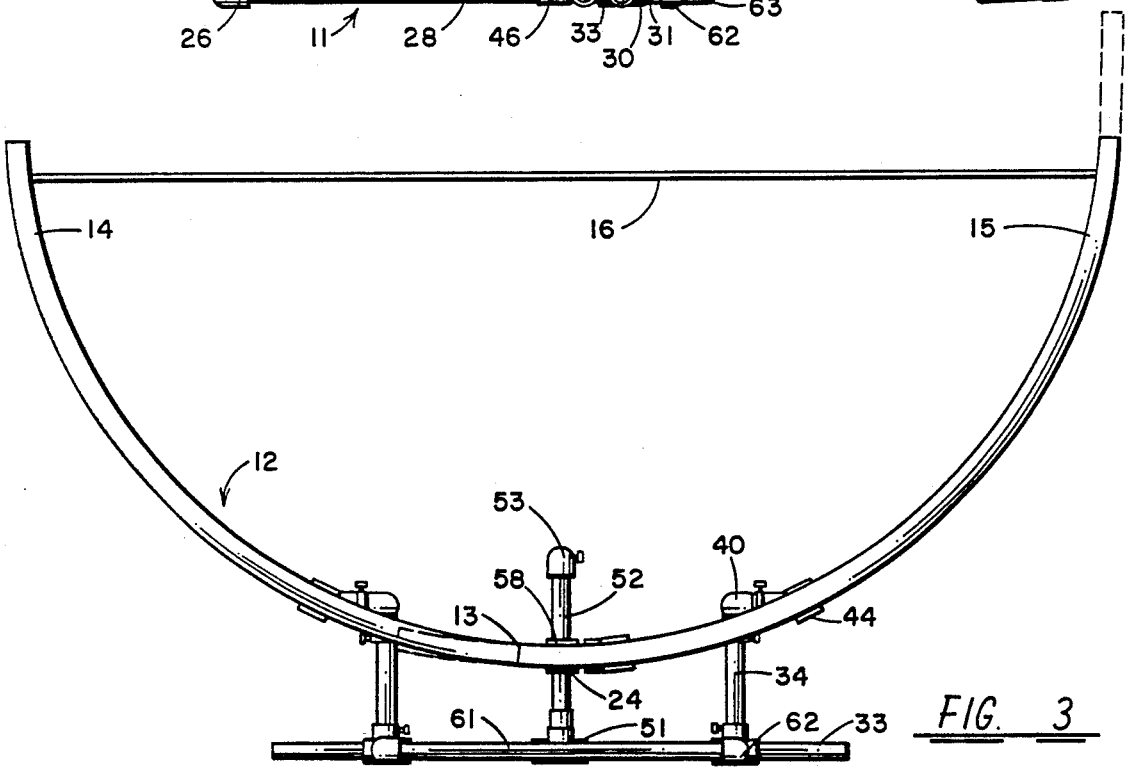
FIG. 3 is a front elevation of the golf training apparatus in accordance with FIGS. 1 and 2.

Referring to the drawings, FIGS. 1-3, a golf training device 10 is illustrated having a frame 11 supporting a golf club swing guide 12 in the form of a half-circular golf club guide made of a plastic pipe formed into a partial circle. A golfer 13 is shown in FIG. 2 having a golf club 14 in his hand having a golf club head 15 in the middle of a stroke following the golf club swing guide 12.

The golf club swing guide 12 is a generally circular shape and made of a high density polyethylene pipe forming a half circle and having a joint 13, a pair of end portions 14 and 15 which are connected with a flexible elongated member 16 which can be a flexible and elastic cord and which is used to align a golfer's shoulders correctly with a target, if desired, attached on each side through openings 17. The embodiment, shown in FIG. 1, has an attachment 18 attached to the end portion 15 and curved outwardly and is a safety feature for beginning golfers which can be easily removed once the golfer becomes more skilled in his stroke and which can be easily set up for use by left or right handed golfers. The guide 12 guides the golfer 20 (FIG. 2) stroke with the golf club 21 during the backstroke only as it slides along the surface of the golf club guide 12 until it passes the end portion 15 and then is free moving behind the golfer to a position as shown in the phantom golf club 22 of FIG. 2. The golfer then brings the club 21 forward without touching the guide 12 in a manner as shown in FIG. 2 to hit a practice ball 23 positioned directly beneath the bottom 24 of the guide 12. An improper swing will prevent the golfer's club from reaching under the bottom 24 of the guide 12 and hitting the ball 23 and will, in some cases, result in the golfer hitting the curved extension 18.

Frame 11 has a plurality of base members 25 connected at the back portion thereof with elbows 26 and between a pair of elbows 26 by a base frame member 27. A pair of elbows 26 connect a pair of forward extending polymer pipes 28 which are coupled into a 5-way coupling 30. The 5-way coupling has a forward protruding portion 31. Inside openings couple a cross base member 32 for connecting the two 5-way couplings 30 together and a pair of outriggers 33 extend outwardly from each coupling 30. The fifth coupling portion extends upward and is connected to an upwardly extending frame member 34 which may be a telescoping frame member having a telescoping portion 35 having a perpendicular sleeve 36 mounted to the top thereof. Each sleeve 36 has an elongated guide supporting arm 37 sliding therein and has a lock screw 38 threaded into the top thereof for locking onto the sliding arms 37 to lock the arm in place. The arms extend past the sleeve 36 and into an elbow 40 having a small polymer pipe portion 41 extending from the other end of the elbow 40 and connected to an additional elbow 42 which has a small pipe section 43 attached thereto. A guide attaching member 44 is attached to pipe 43 and may be a small section of polymer pipe having a strip cut therefrom so that it will snap onto the guide 12. The sleeves 36 allow the side arms 37 on either side to slide therein for adjusting the position of the guide 12 while simultaneously the elbows 40 and 42 allow slight rotation while the guide 12 is being adjusted. The base frame 25 has a second cross brace member 45 extending between the forward extending base arms 28 and connected to a Tee fitting 46 on either side. A tee 47 located in the middle of the cross brace member 45 allows the attachment of a vertical extending frame member 48 which may have a tee 50 on top thereof. Cross brace member 32 in turn has a tee 51 attached therein with a vertically extending frame member 52 extending upwardly therefrom and connected to an elbow 53. A small pipe section 54 connects the elbow 53 to the tee 50. The upwardly extending arm 52 has a tee 55 attached thereon which in turn is attached to a tee 56 which has a center guide support arm 57 sliding in the tee 56 and having a guide 12 attaching clamp 58 on the end thereof which can be made from a pipe tee fitting having a portion cut away so that it can clamp onto the guide 12 between the side clamps 44. A threaded fastener 60 is threaded into the tee 56 to lock down onto the arm 57 to hold the arm in place.

Thus, the guide 12 can be adjusted to any desired angle and position by sliding the arm 57 relative to the pair of arms 37 which thus slides the center support relative to the side supports of the guide 12 to adjust the angle. Once the angle is adjusted in a desired position, the threaded bolts 60 and 38 can be clamped down into their respective arms to lock the guide 12 in the desired position.

The forward extending base frame members 31 have a protective bar 61 extending therebetween and connected into ells 62 on either end thereof. The curved attachment 18 can be easily removed by pulling loose from the end 15 of the guide 12. The coupling 13 between the pipes in the guide 12 can be separated and the attachment 18 placed therebetween to form a different shape which varies from the arcuate shape of the pipe to assist certain golfers in their stroke follow through.

The golfer 20, as shown in FIG. 2, has a golf ball 23 placed on a Tee 63 beneath the bottom 24 of the guide 12. He then practices his back stroke by sliding the club along the guide 12 until it passes the end portion 15 and then continues to the position 22 where it is brought forward without touching the guide 12 to hit the ball 23 under the bottom 24 of the guide 12 to force the golfer 20 to improve his golf stroke. The system illustrated in FIGS. 1-3 is advantageously made primarily of high density polyethylene pipe and couplings including a special 5-way coupling 50 formed for use in the system shown to thereby reduce the number of components utilized for the golf training system. The outriggers 33 provide additional side support and a plurality of eye bolts 64 have been placed on the four corners of the base so that a corner spike can be attached thereto for attaching into the earth or onto a surface to hold the training apparatus 10 in a fixed position during practice. The system can be easily dismantled for shipment or storage.

Figure 4:
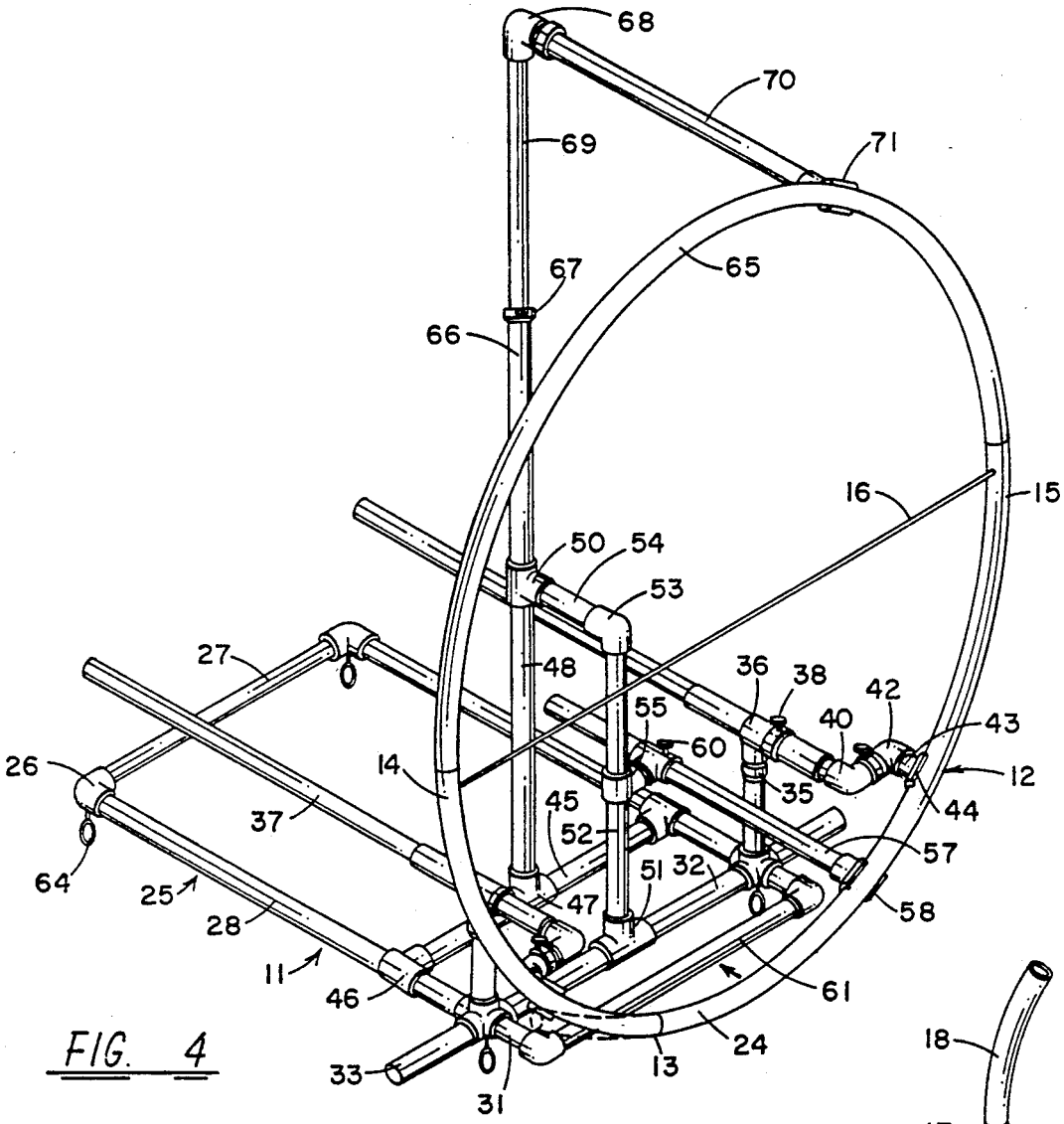
FIG. 4 is a perspective view of an alternate embodiment of a golf training apparatus in accordance with the present invention.

Referring to FIG. 4, an alternate embodiment is illustrated in which the guide 12 is connected with the framework 11 in the same manner as FIGS. 1, 2 and 3 except in this embodiment an additional type attachment 65, which is generally arcuate shaped, connects end portion 14 of the guide 12 and the end portion 15 to form a complete circular guide 12 still supported by the flexible cross support member 16. However, this shape necessitates the addition of an additional vertical upright member 66 being attached into the top of the tee fitting 50 and having a telescoping portion 69 telescoping therein along with a clamp 67 for clamping the telescoping arm 69 in any raised position desired. The telescoping arm 69 has an elbow 68 attached thereto which supports a forwardly extending arm 70 which has a guide attaching bracket 71 on the end thereof which is attached to the accessory guide arm 65. This provides additional support to the top of a fully circular guide 12.

Thus, the golf training apparatus of FIGS. 1-3 can be quickly modified by removing the attachment 18, then adding the additional circular guide portion 65 to form a complete circle and then adding the vertical extending frame members 66 and telescoping the arm 69 to a predetermined height to adjust the position of the arm 70 to add the additional support. Thereafter, the arms 37 and the center guide support arm 57 can be slid within their respective sleeves to position the bottom of the guide 12 to any desired angle relative to the attached arm 70.

The present golf training device 10 allows the golfer to practice in front of the circle 12 and allows the golfer to train his backstroke as well as to force his forward stroke at an angle to allow the club to reach under the bottom 24 of the guide 12 to hit the golf ball 23. Having the golfer in front of the guide 12 also avoids having to design a frame of lesser strength to allow the golfer to have a position inside the golf club guide 12. A supporting member 16 is also positioned for aligning the golfer's shoulders.

The present golf training apparatus 10 advantageously is made of conventional high density polyethylene pipes and fittings and has readily available attachments for use by different golfers but allows the golf club swing guide to be adjusted by sliding the center swing guide support member and the pair of side swing guide support members relative to each other and also allows a golf swing training apparatus guide which guides the golfer's back swing and forces the forward swing of the golfer to hit the ball under the guide member. Quick attachments allow the rapid adjustment to prevent hitting the guide member 12 for beginning golfers in their forward swing and also provides a full circle for beginning golfers. The attachment 18 can also be attached between sections of the circular guide 12 to change the circle to further force the forward swing of the golf club under the swing guide 12. The golf training device can be easily set up for either right or left handed golfers. However, the present invention is not to be considered limited to the forms shown which are to be considered illustrative rather than restrictive.

I claim:

1. A golf training apparatus comprising:

a frame;

a golf club swing guide attached to said frame, said golf club swing guide for guiding a person's swing, said golf club swing guide forming a partially circular pipe member with two end portions and having a flexible support member connected between said end portions;

said frame including:

a base formed of a plurality of frame members and a pair of outrigger members;

a pair of side swing guide support members, each swing guide support member attached to said swing guide and each swing guide support member being slidably mounted in a supporting sleeve on a side upright frame member attached to said base;

a center swing guide support member attached to said swing guide and being supported in a supporting sleeve on a first center upright frame member attached to said base; and a second center upright frame member attached to said base and to said first center upright frame member whereby said golf club swing guide is adjusted by sliding said center swing guide support member and said pair of side swing guide support members relative to each other whereby a golf swing training apparatus guides only the golfers backswing and forces the forward swing of the golfer to hit the ball under the guide member.

2. A golf training apparatus in accordance with claim 1 in which said base has a plurality of eye attachments for anchoring said training apparatus to a surface.

3. A golf training apparatus in accordance with claim 1 in which said base includes a pair of 5-way pipe fittings.

4. A golf training apparatus in accordance with claim 3 in which each said 5-way pipe fitting has an outrigger pipe extending therefrom.

5. A golf training apparatus in accordance with claim 4 in which said base has a forward protective bar attached thereto.

6. A golf training apparatus in accordance with claim 1 in which said flexible support member is an elastic support cord positioned for aligning a golfer's shoulders therewith.

7. A golf training apparatus in accordance with claim 6 in which said golf club guide has a full circle extension attached thereto

8. A golf training apparatus in accordance with claim 7 in which said second center upright frame has a telescoping extension and has a circle extension support member.

9. A golf training apparatus in accordance with claim 1 having a golf club swing guide end portion attachment thereon attached to one end portion of said golf club swing guide and curved to catch the forward swing of a golf club.

10. A golf training apparatus in accordance with claim 9 in which said golf club swing guide end portion attachment is arcuate shaped.

11. A golf training apparatus in accordance with claim 10 in which said guide adjustment means has height adjustment means for said golf club swing guide including a pair of vertically extending telescoping frame members and has means for locking said telescoping members in a preset position to thereby raise and lower said swing guide support members and said swing guide.

12. A golf training apparatus in accordance with claim 11 in which each swing guide support member has slide locking means for locking each said swing guide support member in a predetermined position onto one frame member.

* * * * *